US010125532B2

(12) United States Patent
Rocca, Jr.

(10) Patent No.: US 10,125,532 B2
(45) **Date of Patent: *Nov. 13, 2018**

(54) REPLACEMENT WINDOW JAMB EXTENDER

(71) Applicant: WINJET, LLC, Berea, OH (US)

(72) Inventor: Samuel Mark Rocca, Jr., Cleveland, OH (US)

(73) Assignee: WINJET, LLC, Berea, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/356,409

(22) Filed: Nov. 18, 2016

(65) Prior Publication Data

US 2017/0356234 A1 Dec. 14, 2017

Related U.S. Application Data

(60) Provisional application No. 62/392,878, filed on Jun. 13, 2016.

(51) Int. Cl.
*E06B 1/04* (2006.01)
*E06B 1/02* (2006.01)

(52) U.S. Cl.
CPC ..... *E06B 1/02* (2013.01)

(58) Field of Classification Search
CPC ..... E06B 1/02
USPC ..... 52/204.1, 204.5, 217
See application file for complete search history.

(56) References Cited

U.S. PATENT DOCUMENTS 3,583,114 A * 6/1971 Belfor ..... E06B 1/6015 49/505
3,997,025 A * 12/1976 Price ..... B65D 90/54 182/77
4,267,673 A * 5/1981 Coulston ..... E06B 1/325 428/57
4,328,644 A * 5/1982 Scott ..... E06B 3/302 49/501
4,694,612 A * 9/1987 Pruden ..... E06B 3/44 49/445
5,392,574 A * 2/1995 Sayers ..... E06B 1/30 49/DIG. 2
5,555,684 A * 9/1996 Galowitz ..... E06B 1/342 52/204.5

(Continued)

OTHER PUBLICATIONS

International Search Report dated Sep. 1, 2017 for International application No. PCT/US17/37278.

(Continued)

*Primary Examiner* — Basil S Katcheves
(74) *Attorney, Agent, or Firm* — Fay Sharpe LLP

(57) ABSTRACT

A replacement window jamb extender accommodates a frame of a replacement window of a predefined geometry within an existing depth of a jamb. The replacement window jamb extender comprises a substantially L-shaped frame and a self-adhering and self-sealing flange. The L-shaped frame is configured to be fixedly attached to a window slot on a wall, where an inner side of the L-shaped frame is configured to accommodate the frame of the replacement window within the existing depth of the jamb. The double sided adhesive tape extends from an outer side of the L-shaped frame, and the self-adhering and self-sealing flange is configured to fixedly attach the L-shaped frame on the outer panel attached on an outer side of the wall.

2 Claims, 5 Drawing Sheets

(56) References Cited

U.S. PATENT DOCUMENTS

| | | | | |
|---|---|---|---|---|
| 5,581,970 | A * | 12/1996 | O'Shea | E06B 7/14 52/204.53 |
| 5,603,585 | A * | 2/1997 | Bruchu | B29C 65/20 403/382 |
| 5,941,033 | A | 8/1999 | Adams | |
| 6,427,398 | B1 | 8/2002 | Levine et al. | |
| 6,725,610 | B2 | 4/2004 | Murphy et al. | |
| 6,763,638 | B1 * | 7/2004 | Berger, Jr. | E06B 3/5892 52/204.5 |
| 7,284,353 | B2 | 10/2007 | Bealko | |
| RE40,041 | E * | 2/2008 | Sayers | 49/DIG. 2 |
| 7,631,465 | B2 | 12/2009 | Curtis | |
| 7,874,106 | B2 * | 1/2011 | Pangburn | E06B 1/68 29/464 |
| 8,024,898 | B2 | 9/2011 | Alvarado | |
| 8,607,514 | B2 * | 12/2013 | Peterson | E06B 1/26 52/211 |
| 8,984,820 | B1 | 3/2015 | Kownacki et al. | |
| 2003/0056450 | A1 | 3/2003 | Bealko | |
| 2004/0010989 | A1 * | 1/2004 | Rivest | E06B 1/62 52/204.5 |
| 2004/0187408 | A1 | 9/2004 | Smith | |
| 2004/0226232 | A1 * | 11/2004 | Engebretson | E06B 1/345 52/204.1 |
| 2005/0072073 | A1 * | 4/2005 | Inelli | E06B 1/30 52/204.1 |
| 2006/0143996 | A1 * | 7/2006 | Alvarado | E06B 1/02 52/204.53 |
| 2007/0277455 | A1 | 12/2007 | Flanigan et al. | |
| 2009/0044466 | A1 * | 2/2009 | Andres | E04F 19/02 52/204.53 |
| 2012/0055107 | A1 | 3/2012 | Butler et al. | |
| 2014/0123589 | A1 | 5/2014 | Yeomans et al. | |

OTHER PUBLICATIONS

Written Opinion dated Sep. 1, 2017 for International application No. PCT/US17/37278.

Notice of Co-pending U.S. Appl. No. 15/621,700, filed Jun. 13, 2017.

* cited by examiner

REPLACEMENT WINDOW JAMB EXTENDER

CROSS REFERENCE TO RELATED APPLICATIONS

This application claims the benefit of provisional patent application No. 62/392,878, filed in the United States Patent and Trademark Office on Jun. 13, 2016. The specification of the above referenced patent application is incorporated herein by reference in its entirety.

FIELD OF THE INVENTION

The present invention relates to a device to modify jamb dimensions to ease carpentry work on windows. More particularly, the present invention relates to a window jamb extender configured to allow installation of new windows.

BACKGROUND

Replacement or retrofit windows are installed sometimes as an insert within master frames of existing windows. Alternately, a full frame replacement includes completely removing the existing window frames down to jack studs, and installing the replacement window. The existing windows are constructed of a wide variety of materials, for example, wood, or non-wood type. Conventionally, full frame replacements are best practiced when working with non-wood existing windows. This often requires additional labor and materials to complete the installation compared to the insert replacement method. Traditionally, with the increasing use of vinyl in new construction windows, these windows are mounted to a new house via an integral flange with an integrated J-channel. The window frames mount to the jambs about two inches from the exterior wall, which is about 1-inch to 1¼-inch less than other windows when installed flush with the exterior building wall.

Often, to efficiently replace these windows with replacement windows, a full frame replacement is best practice as the existing window master frames cannot be used and must be completely removed. Typically, the jamb mounting depth (dimension of window interior to exterior wall) is about two inches. A replacement window frame is normally 3¼-inches thick, so it will not fit in the same jamb mounting area. Currently, there are three methods for installing a replacement window when the existing jamb mounting depth is too small to fit the replacement window. The first method includes increasing the jamb mounting area to the interior of the house. If the jamb mounting area is increased to the interior of the home, additional carpentry and finish work is required for, including but not limited to, interior casing or drywall, drywall work, painting, staining, new interior casing and or new window treatments, as the existing window treatments may lose their mounting area on the existing returns. An apparatus, which prevents the need for increasing the jamb mounting area to the interior of the home, is required.

The second method includes extending the jambs with lumber to increase the jamb mounting area to the exterior of the building. If the jamb mounting area is extended to the exterior, this also requires additional carpentry to fabricate new wood jamb extensions inside of the existing house framing and reduces the rough opening size for the new replacement window resulting in a smaller window with less visible glass area. On the exterior, extensive trim work is commonly required, including but not limited to, careful removal and reinstallation of existing siding or cladding to remove the existing window and install new J-channel, trim work required to cover exterior stops and jamb extensions if used. Therefore, an apparatus which prevents the need for increasing the jamb mounting area to the exterior of the home, is required.

The third method includes selecting a replacement window that also has an integral flange and utilizes a similar jamb depth which is again an expensive process. When a replacement window with an integral nail flange is used, there is less interior carpentry work than in other methods since the jamb depth is the same but there is still extensive exterior work that must be done, including but not limited to, careful removal and reinstallation of exterior cladding, and fastening and sealing the new integral nail flange to the building. This cladding removal, frequently vinyl siding, is difficult because if a piece of siding is damaged and needs to be replaced it is difficult to match siding that has faded or may no longer be available from the original manufacturer. Overall, when required the exterior cladding work to remove and reinstall the cladding around every window in the home, around existing landscaping, variable exterior grading, working with scaffolding when required, is very time and cost intensive. An apparatus, which prevents the need for extensive exterior work of the home, is required.

Hence, there is a long felt but unresolved need for an apparatus, which prevents the need for increasing the jamb mounting area to the interior of the home. Moreover, there is a need for an apparatus, which prevents the need for increasing the jamb mounting area to the exterior of the home without extensive carpentry and lumber. Furthermore, there is a need for an apparatus, which prevents the need for extensive exterior work of the home.

SUMMARY OF THE INVENTION

A replacement window jamb extender accommodates a frame of a replacement window of a predefined geometry within an existing depth of a jamb. The replacement window jamb extender comprises a substantially L-shaped frame and double sided adhesive tape. The L-shaped frame is configured to be fixedly attached to an existing window slot on a wall, where an inner side of the L-shaped frame is configured to accommodate the frame of the replacement window within the existing depth of the jamb. The double sided adhesive tape extends from an outer side of the L-shaped frame, and the double sided adhesive tape is configured to fixedly attach the L-shaped frame on the outer panel attached to the existing jamb of the wall.

In an embodiment, a bottom section of the L-shaped frame is configured to be positioned up to a drywall or similar section extending from an inner side of the wall. In an embodiment, the replacement window jamb extender further comprises a flange attached to the L-shaped frame, wherein the flange is self-adhering and self-sealing to allow the flange to be positioned behind existing cladding covering the outer side of the wall. In an embodiment, the replacement window jamb extender further comprises a J-channel fin which forms a groove between the flange and the J-channel fin which accepts the existing exterior cladding. In an embodiment, the replacement window jamb extender further comprises an integral extruded exterior stop positioned proximal to the interior double sided adhesive tape and extending from the outer side of the L-shaped frame towards the window slot, wherein the integral extruded exterior stop is configured to eliminate additional exterior trim work required during attaching a replacement window.

In an embodiment, the replacement window jamb extender further comprises a counter sunk screw configured to attach the L-shaped frame to the wall, wherein the counter sunk screw is inserted from the inner side of the L-shaped frame.

DETAILED DESCRIPTION OF THE INVENTION

Figure 1A:
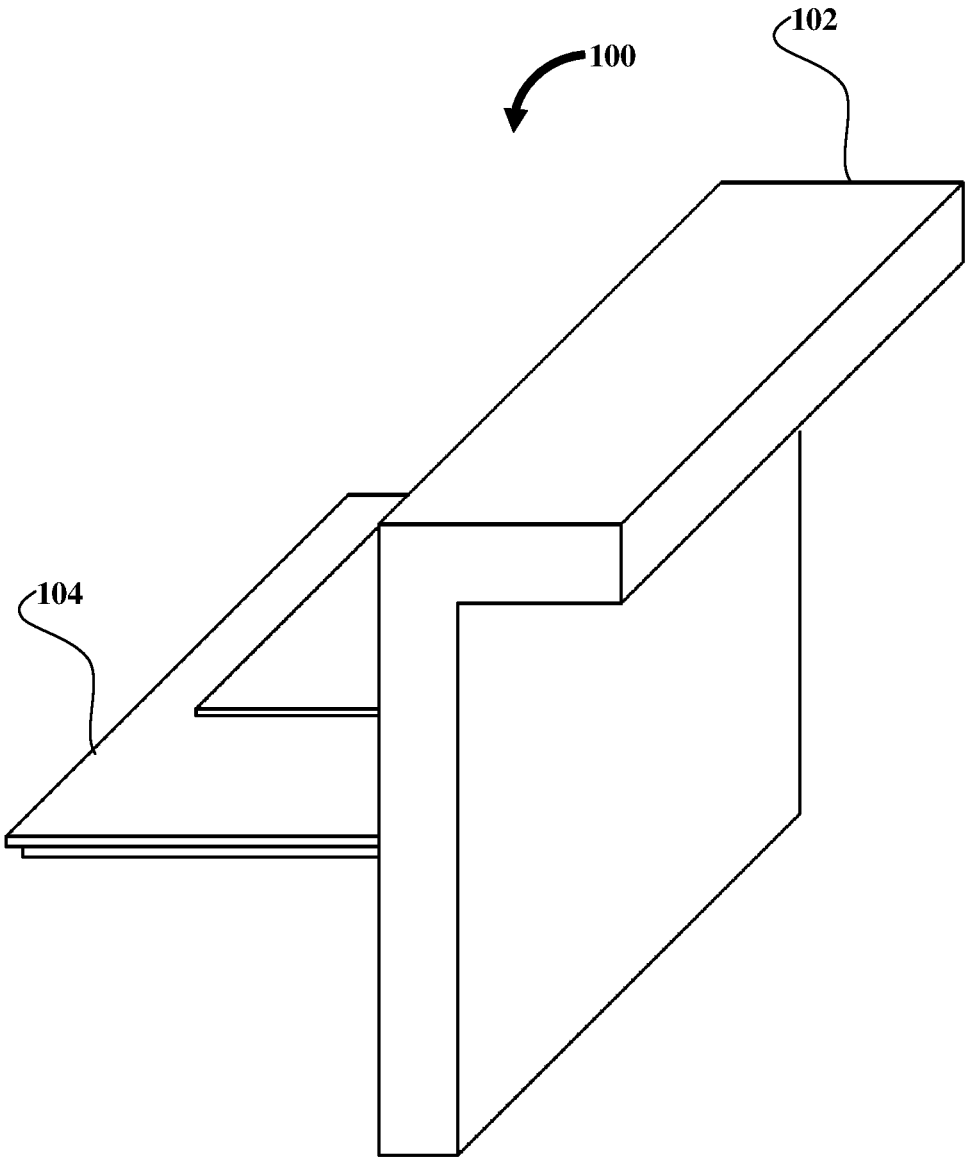
FIG. 1A exemplarily illustrates a front perspective view of the replacement window jamb extender.
Figure 1B:
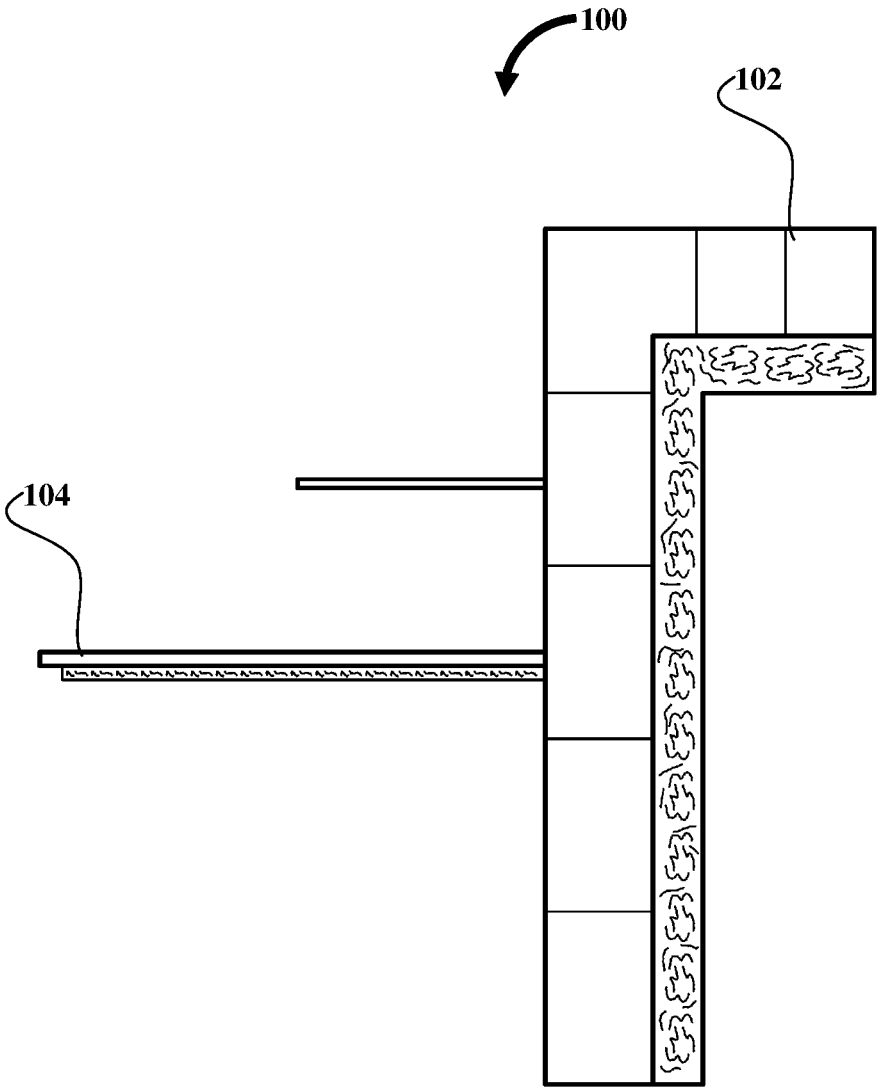
FIG. 1B exemplarily illustrates a side sectional view of the replacement window jamb extender.
Figure 1C:
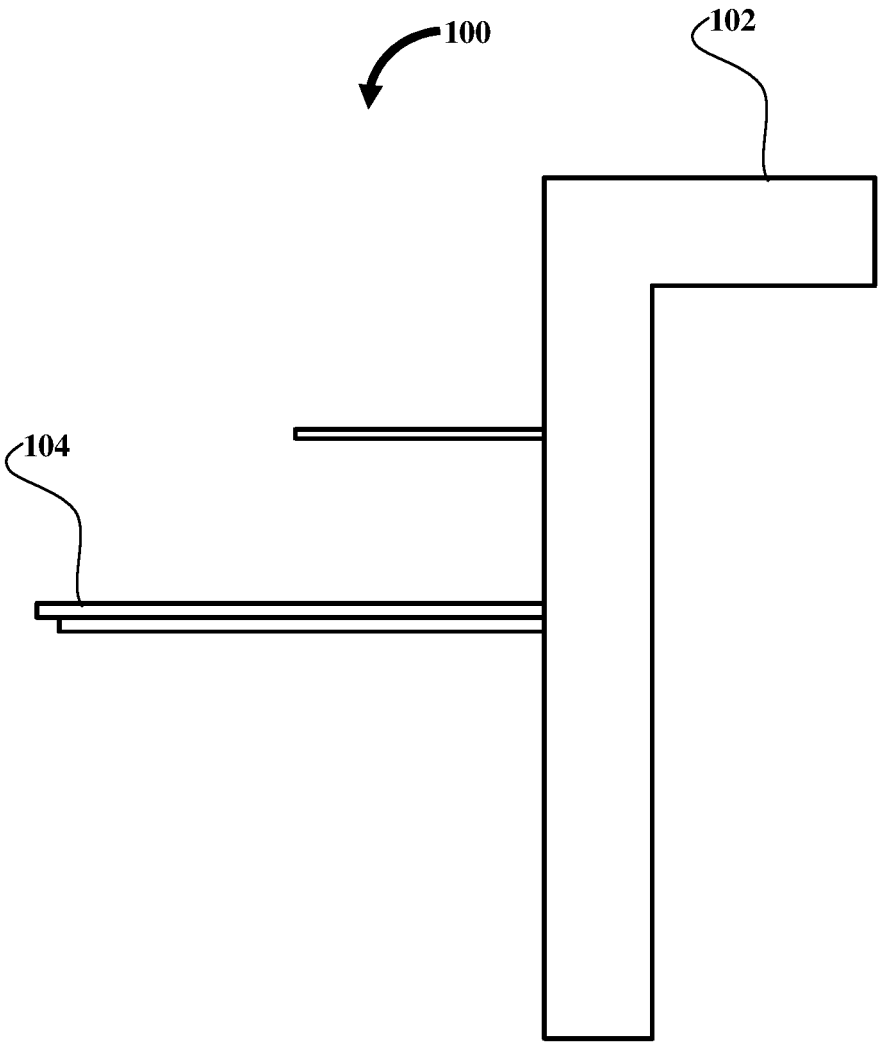
FIG. 1C exemplarily illustrates a side view the replacement window jamb extender made of wood.
Figure 2:
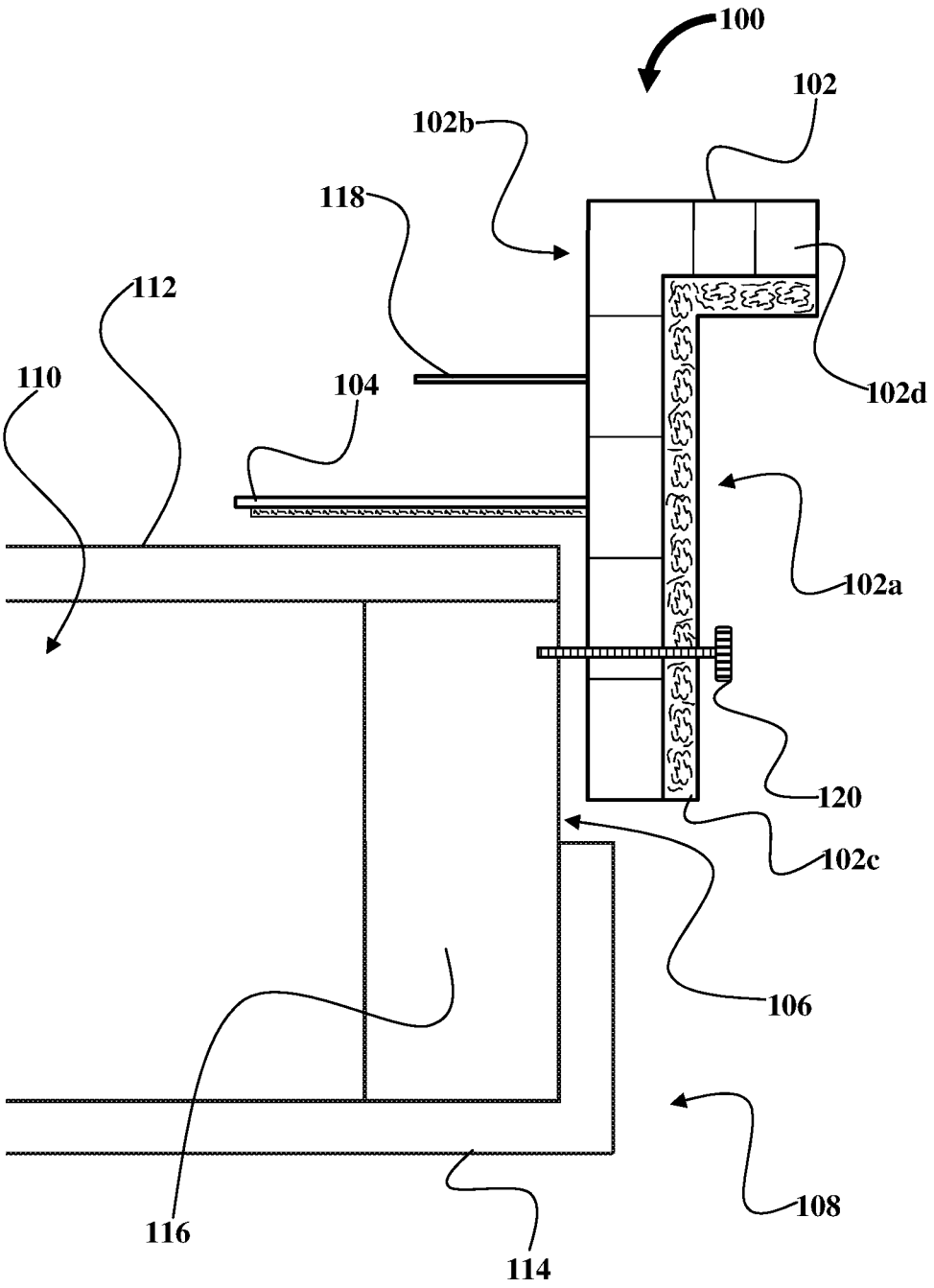
FIG. 2 exemplarily illustrates a side view the replacement window jamb extender being attached to the wall stud member.

The replacement window jamb extender 100 is an extruded one piece element with a built-in flange and J-channel containing a self-adhesive seal tape 104 on the flange to replace a new construction window. FIG. 1A exemplarily illustrates a front perspective view of the replacement window jamb extender 100, FIG. 1B exemplarily illustrates a side sectional view of the replacement window jamb extender 100, and FIG. 1C exemplarily illustrates a side view the replacement window jamb extender 100 made of wood. The replacement window jamb extender 100 is the solution for replacing new construction type windows with a more efficient replacement window. As per the construction, the replacement window jamb extender 100 accommodates a frame of a replacement window of a predefined geometry within an existing depth of a jamb 106 as shown in FIG. 2. The replacement window jamb extender 100 comprises a substantially L-shaped frame 102 and a flange with self-adhering and self-sealing tape 104. The replacement window jamb extender 100 is configured to be molded as a one-piece vinyl or similar building material product to be either of chambered or of solid construction, and the product can be molded in multiple colors, and can be modified into woodgrain or laminate color coatings, or a matte finish.

The replacement window jamb extender 100 can accommodate any common size or depth of any replacement window frame without concern for the existing depth of the house jamb 106, thickness of the existing new construction window, or the mounting depth of the jamb 106. The replacement window jamb extender 100 produces a clean, quickly and efficiently installable, and a readymade finished product compared to the other methods or devices available in the market. When installed, the replacement window jamb extender 100 allows a replacement window to utilize the same mounting depth of the jamb 106, and it does not require extensive finish work as it has an accommodating integral J-channel for the existing cladding, and comprises a self-adhering and self-sealing flange 104 which slides behind existing cladding. To the interior, depending on the existing window and other building materials, minimal to no interior work is required as the same mounting depth of the jamb 106 is used and no drywall or wood trim work is necessary.

FIG. 2 exemplarily illustrates a side view the replacement window jamb extender 100 being attached to the stud member. As disclosed in FIGS. 1A-1B, the replacement window jamb extender 100 is configured to accommodate the frame of a replacement window of a predefined geometry within an existing depth of a jamb 106 in an already existing construction. The replacement window jamb extender 100 includes the L-shaped frame 102 and a flange with self-adhering and self-sealing tape 104. The L-shaped frame 102 is configured to be fixedly attached to a window slot 108 on a wall 110, where an inner side 102*a* of the L-shaped frame 102 is configured to accommodate the frame of the replacement window within the existing depth of the jamb mounting area 106. The flange 104 extends from an outer side 102*b* of the L-shaped frame 102, and the flange 104 is configured to fixedly attach the L-shaped frame 102 on an outer panel 112 attached on an outer side of the wall 110. The outer panel 112 is, for example, 0.5-inch ply wood, and the wall 110 is 4.5 inches in thickness overall including the outer panel 112 and interior drywall section 114.

In an embodiment, a bottom section 102*c* of the L-shaped frame 102 is configured to be positioned up to a drywall section 114 extending from an inner side of the wall 110. The drywall section 114, for example, about 0.5 inches, found in the inner portion of walls 110 extend towards the window slot 108 to receive the bottom section 102*c* of the L-shaped frame 102. The wall 110 terminates at a nominal 2 inches× 4-inches stud member 116 and the drywall section 114 extends over the stud member 116 to define the jamb mounting area 106. In an embodiment, the replacement window jamb extender 100 further comprises an integral J-channel fin 118 positioned proximal to the flange 104 and extending from the outer side 102*b* of the L-shaped frame 102. In an embodiment, the J-channel fin 118 forms a groove between the flange 104 and the J-channel fin 118 which accepts the existing exterior cladding. The integral extruded exterior stop 102*d* is configured to eliminate additional exterior trim work that might be required during the installation or attachment of the replacement window.

In an embodiment, the replacement window jamb extender 100 further comprises a flange 104 attached to the L-shaped frame 102, wherein the flange 104 is self-adhering and self-sealing to allow the flange 104 to be positioned behind an existing cladding covering the outer side of the wall 110. In an embodiment, the replacement window jamb extender 100 further comprises a counter sunk screw 120 configured to attach the L-shaped frame 102 to the wall stud member 116, where the counter sunk screw 120 is inserted from the inner side 102*a* of the L-shaped frame 102. The counter sunk screw 120 is screwed to the stud member 116 to increase the stability of the replacement window jamb extender 100 over the wall 110, stud member 116 and the outer panel 112.

The installation of the replacement window jamb extender 100 comprises different steps. Primarily, the user needs to remove the old window unit ensuring all nails and debris is removed from the space surrounding the window slot 108. The remaining siding nails are recommended to be removed using a reciprocating saw to obtain a clean surface for the installation of the replacement window jamb extender 100. The previous J-channel attached to the old window unit must be removed, and a sealant is applied to the interior jamb 106 and drywall exterior edge 114. Now, the replacement window jamb extender 100 is cut as per the required dimension, and top gasket seal and side gasket seal are applied.

In other words, the distance between the jambs 106 is measured for the top header and the replacement window jamb extender 100 is cut at an angle of 45 degrees on each side. Then the sealant is applied to the jamb 106 and the drywall exterior edge 114. The sealant can be further applied on a shim if necessary. Pre-drilling of the outside corners is performed and the sealant is applied to the holes and the screws, for example, counter sunk screw 120. Now the measuring tape is removed and the replacement window jamb extender 100 is secured with the counter sunk screw 120. Now, the side pieces are measured, as well as top header to sill portion, and then the replacement window jamb extender 100 is cut at 45 degree angles in preparation for a miter joint. Now the tape is removed, and the assembly of the replacement window jamb extender 100 is leveled and secured, where a gasket seal or sealant is applied to the corners.

The bottom piece of the replacement window jamb extender 100 is measured, and this bottom sill piece is of similar length as that of the top header piece. The bottom piece of the replacement window jamb extender 100 is slid into place and secured with screws. However, the siding may have to be removed and re-applied to properly fit. Finally, the 4 pre-drilled outside corners are filled with the gasket seal to finish the installation of the replacement window jamb extender 100.

Figure 3:
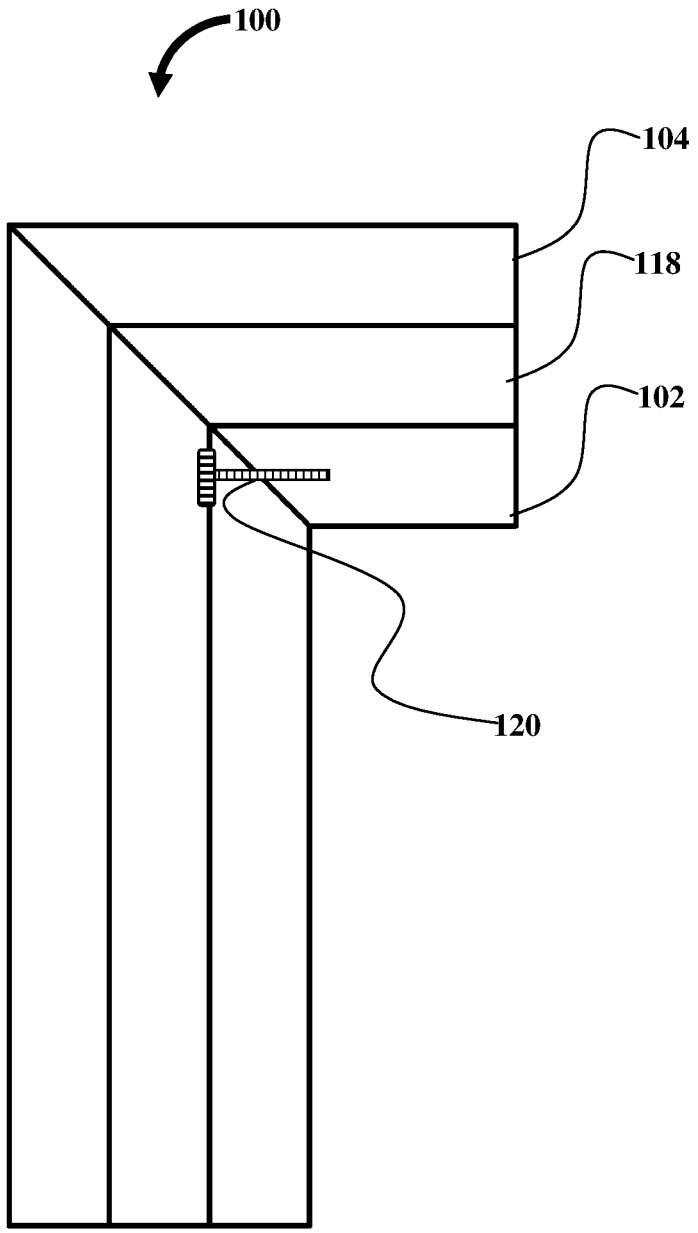
FIG. 3 exemplarily illustrates a front view of the replacement window jamb extender.

FIG. 3 exemplarily illustrates a front view of the replacement window jamb extender 100. Here, one of the outside corners of the assembled replacement window jamb extender 100 is shown. The integral extruded J-channel fin 118 and the integral flange 104, both which extend from the L-shaped frame 102 is shown. The assembly of the replacement window jamb extender 100 as described above, provides a chambered appearance to the viewer. The counter sunk screw 120 as shown here, keeps the replacement window jamb extender 100 secured to the stud member 116 as shown in FIG. 2. The integral flange 104 would not be visible at completion as it is covered by the exterior cladding.

The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation. Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

I claim:

1. A replacement window jamb extender to accommodate a frame of an associated replacement window of a predefined geometry within an existing jamb, the replacement window jamb extender comprising:

a one-piece substantially L-shaped frame configured to be fixedly attached to a window slot on an associated wall, said frame comprising: (i) a bottom section adapted to be located in said window slot and be connected to a stud member of the associated wall; (ii) an exterior stop connected to the bottom section; wherein an inner side of the L-shaped frame is configured to accommodate the frame of the associated replacement window adjacent the bottom section and exterior stop; and a flange that extends from an outer side of the bottom section of the frame, said flange adapted to be located adjacent an outer side of the associated wall and comprising an adhesive located thereon, wherein said adhesive is configured to adhere the flange to the outer side of the associated wall;

a J-channel fin that extends from an outer side of the bottom section of the frame proximate the flange such that a groove is formed between the flange and the J-channel fin, wherein said groove is adapted to receive associated exterior cladding located adjacent the outer side of the associated wall.

2. A method of installing a replacement window on a window slot of a wall, the method comprising:

providing replacement window jamb extender to accommodate a frame of the replacement window of a predefined geometry within an existing jamb, the replacement window jamb extender comprising;

a one-piece substantially L-shaped frame configured to be fixedly attached to a window slot on an associated wall, said frame comprising: (i) a bottom section adapted to be located in said window slot and be connected to a stud member of the associated wall; (ii) an exterior stop connected to the bottom section; wherein an inner side of the L-shaped frame is configured to accommodate the frame of the associated replacement window adjacent the bottom section and exterior stop; and a flange that extends from an outer side of the bottom section of the frame, said flange adapted to be located adjacent an outer side of the associated wall and comprising adhesive located thereon;

a J-channel fin that extends from an outer side of the bottom section of the frame proximate the flange such that a groove is formed between the flange and the J-channel fin, wherein said groove is adapted to receive associated exterior cladding located adjacent the outer side of the associated wall;

locating the L-shaped frame in the window slot and fixedly attaching the L-shaped frame to a stud member of the wall;

fixedly attaching the flange of the L-shaped frame to an outer side of the wall by adhering the adhesive to the outer side of the wall; and locating a frame of a replacement window in-adjacent the bottom section and the exterior stop on an inner side of the L-shaped frame.

* * * * *